US005302142A

United States Patent [19]

Tabata

[11] Patent Number: 5,302,142

[45] Date of Patent: Apr. 12, 1994

[54] BATTERY TERMINAL

[75] Inventor: Masaaki Tabata, Yokkaichi, Japan

[73] Assignee: Sumitomo Wiring Systems, Ltd., Yokkaichi, Japan

[21] Appl. No.: 99,647

[22] Filed: Jul. 30, 1993

[30] Foreign Application Priority Data

Sep. 10, 1992 [JP] Japan ..... 4-63406

[51] Int. Cl.[5] ..... H01R 13/631

[52] U.S. Cl. ..... 439/762; 439/770

[58] Field of Search ..... 439/762–765, 439/770, 772, 774

[56] References Cited

U.S. PATENT DOCUMENTS 3,568,139 3/1971 Delzer ..... 439/759
5,088,941 2/1992 Nolle ..... 439/762

FOREIGN PATENT DOCUMENTS 4-7567 2/1992 Japan .
4-9736 3/1992 Japan .
624673 6/1949 United Kingdom .

*Primary Examiner*—Gary F. Paumen
*Attorney, Agent, or Firm*—Sandler, Greenblum & Bernstein

[57] ABSTRACT

A battery terminal for fixing a circular electrode engaging portion thereof to an outer surface of a battery post, wherein a rotatable nut interposed between the tightening plates in such a manner that a supporting shaft projecting from each of opposed side walls of the rotatable nut is rotatably inserted through each of the opposed through-holes formed on the tightening plates; and a tightening tool, having an approximately trapezoidal cut-out portion which is formed on each of side walls thereof and has a pair of tapered surfaces which are brought into contact with an outer surface of each of the tightening plates; and a bolt-installing through-hole, formed on an upper surface thereof, through which a bolt is tightened into the rotatable nut, the bolt being tightened, via the bolt-installing through-hole of the tightening tool, into the rotatable nut located at a desired angle by means of the shafts of the rotatable nut.

4 Claims, 5 Drawing Sheets

BATTERY TERMINAL

BACKGROUND OF THE INVENTION

1. Field of the Invention

The present invention relates to a battery terminal to be installed on an electrode (battery post) of a battery mounted on a car or the like and more particularly to the battery terminal to be installed on the battery post in a desired direction, for example, vertically, obliquely or horizontally.

2. Description of the Related Arts

As shown in FIG. 7, a battery post 2 projecting upward from the upper surface of a battery 1 is inserted into an electrode engaging portion 3*a* of a battery terminal 3. A bolt 4 is horizontally inserted into a bolt opening of a substrate 3*b* and that of a tightening plate 3*c*. A nut 6 is tightened horizontally on the bolt 4 with an impact wrench 5 disposed horizontally. Then, the electrode engaging portion 3*a* is pressed against the battery post 2 to fix the battery terminal 3 to the battery post 2.

In recent years, component parts are installed in the engine room of the car in a high density. For example, projections such as an air duct higher than the battery post or electric wires are installed in the periphery of the battery. In tightening the nut 6 on the bolt 4, with the bolt 4 and the impact wrench 5 disposed horizontally, the following problems occur: The impact wrench 5 may contact other parts and thus it is difficult to tighten the nut 6 on the bolt 4 or it is impossible to tighten the nut 6 thereon if there is no space in which the impact wrench 5 can be placed horizontally.

If the impact wrench 5 and other parts interfere with each other while the plus side of the battery post is being tightened, a short circuit occurs when the impact wrench 5 interferes with the minus side thereof. Even a fire may occur in the car. Therefore, it is necessary to alter the configurations of other parts so as to prevent the interference between the impact wrench 5 and other parts.

In order to overcome the above-described problems, the following battery terminal is proposed in Examined Japanese Patent Laid-Open Utility Model Publication No. 4-7567 as shown in FIG. 8: That is, the bolt 4 is inclined at an acute angle with respect to the axis of the electrode engaging portion 3*a* of the battery terminal 3, and the nut 6 is tightened obliquely downward toward the head of the bolt 4 by the impact wrench 5.

The following battery terminal is also proposed in Examined Japanese Utility Model Publication No. 4-9736 as shown in FIGS. 9A and 9B: That is, the battery terminal comprises a substrate 3*b*'; a tightening plate 3*c*' opposed to each other and inversely tapered; and a crimping plate 7 inversely tapered and stretching over the substrate 3*b*' and the tightening plate 3*c*'. The bolt 4 is tightened downward on the crimping plate 7 so that the crimping plate 7 presses substrate 3*b*' and the tightening plate 3*c*' downward. In this manner, an electrode engaging portion 3*a*' is pressed against the battery post 2.

In the above described battery terminal shown in FIG. 8, since the nut 6 is tightened downward obliquely, the substrate 3*b* and the tightening plate 3*c* are formed by imparting torsion thereto so that they incline with respect to the axial direction of the electrode engaging portion 3*a*. The direction in which the twisted substrate 3*b* and the tightening plate 3*c* are moved toward each other is different from the direction in which the electrode engaging portion 3*a* is pressed against the peripheral surface of the battery post 2. Therefore, the force generated by the nut 6 tightened on the bolt 4 cannot be preferably applied to the direction in which the electrode engaging portion 3*a* is pressed against the peripheral surface of the battery post 2.

In the battery terminal shown in FIGS. 9A and 9B, both sides of the crimping plate 7 are inversely tapered. As a result, the force generated by the nut 6 tightened on the bolt 4 acts outward as well as inward and thus, the sides 7*a* and 7*b* of the crimping plate 7 do not preferably apply tightening force inward to the substrate 3*b*' and the tightening plate 3*c*'. As a result, there is a disadvantage that the electrode engaging portion 3*a*' cannot be reliably pressed against the battery post 2.

In the battery terminal disclosed in Examined Japanese Patent Laid-Open Utility Model Publications No. 4-7567, the nut is tightened only obliquely. In the battery terminal disclosed in Examined Japanese Patent Laid-Open Utility Model Publications No. 4-9736, the bolt is tightened only laterally or vertically. The installing position of main bodies of battery terminals are varied depending on the kind of a car. For example, an operator has difficulty in tightening the bolt vertically when the distance between the operator and the battery is long. The operator has also difficulty in tightening the bolt obliquely when the distance between the operator and the battery is short. The operator has also difficulty in tightening the bolt laterally because there is often a small space into which an impact wrench for tightening the bolt is inserted. Thus, it is necessary to select a battery terminal in installing it on the battery depending on the kind of a car.

SUMMARY OF THE INVENTION

It is an object of the present invention to provide a battery terminal in which a bolt can be tightened in any desired directions so that an impact wrench can be prevented from interfering with parts of a car.

It is another object of the present invention to provide a battery terminal which allows an electrode engaging portion to be reliably pressed against a battery post by converting tightening force acting in a certain direction into a force, in a horizontal direction, for approaching a pair of tightening plates to each other, namely, for moving a free end of the electrode engaging portion connected with the tightening plates in the closing direction thereof.

In accomplishing these and other objects, there is provided a battery terminal for fixing a circular electrode engaging portion thereof to an outer surface of a battery post. The battery terminal comprises: a terminal main body comprising a pair of tightening plates, each having a through-hole formed thereon, continuous with an open free end of the electrode engaging portion into which the battery post is inserted; and an electric wire connecting portion continuous with the electrode engaging portion. The battery terminal further comprises: a rotatable nut interposed between the tightening plates in such a manner that a supporting shaft projecting from each of opposed side walls of the rotatable nut is rotatably inserted through each of the opposed through-holes formed on the tightening plates; and a tightening tool, approximately U-shaped, having an approximately trapezoidal cut-out portion which is formed on each of side walls thereof and has a pair of tapered surfaces which are brought into contact with an outer surface of each of the tightening plates; and a bolt-installing through-hole, formed on an upper surface thereof, through which a bolt is tightened into the rotatable nut. The bolt is tightened, via the bolt-installing through-hole of the tightening tool, into the rotatable nut located at a desired angle by means of the shafts of the rotatable nut. The tapered surfaces of the tightening tool move the tightening plates in a direction in which the free end of the electrode engaging portion is closed.

According to the above-described construction, since the nut is rotatably installed on the terminal main body, the direction of the nut can be adjusted to a direction in which an operator can tighten the bolt most easily via the tightening tool. That is, the bolt can be tightened in appropriate directions in correspondence with terminal main body-installing positions which are different from each other depending on the kind of a car. Therefore, the preparation of the battery terminal according to the present invention eliminates the need for preparing many kinds of battery terminals which are installed on the battery post by tightening the bolt in various directions.

Further, the more the bolt is tightened into the bolt opening of the nut via the tightening tool, the more the tapered surfaces of the tightening tool approach the pair of the tightening plates of the terminal main body to each other horizontally. As a result, the free end of the electrode engaging portion connected with the tightening plates is moved in the free end-closing direction. In this manner, the electrode engaging portion can be reliably pressed against the peripheral surface of the battery post.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
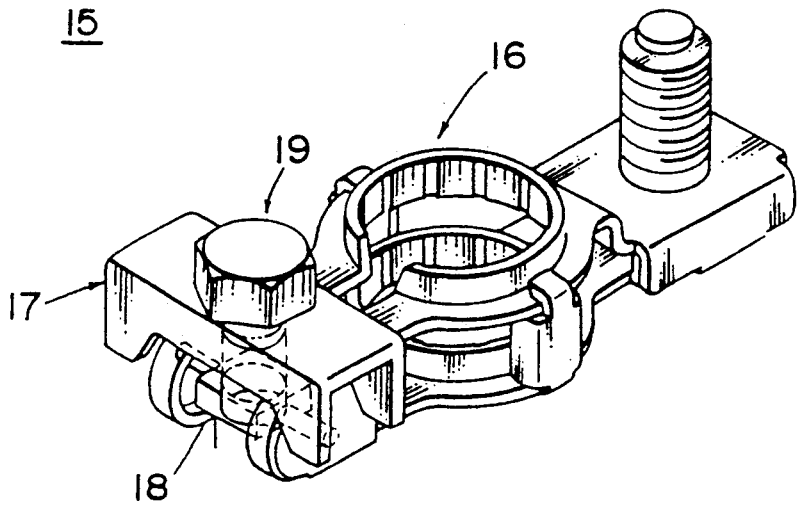
FIG. 1 is a perspective view showing a battery terminal according to an embodiment of the present invention.

Before the description of the present invention proceeds, it is to be noted that like parts are designated by like reference numerals throughout the accompanying drawings.

Referring to FIGS. 1 through 6, a battery terminal according to an embodiment of the present invention is described below.

In the battery terminal 15, a rotatable nut 18 is rotatably installed on a terminal main body 16, and a bolt 19 is tightened into the rotatable nut 18 so as to fix the terminal main body 16 to the terminal main body 16, with the nut 18 rotated at a desired angle so as to fix the battery terminal 15 to a battery post 2.

Figure 2:
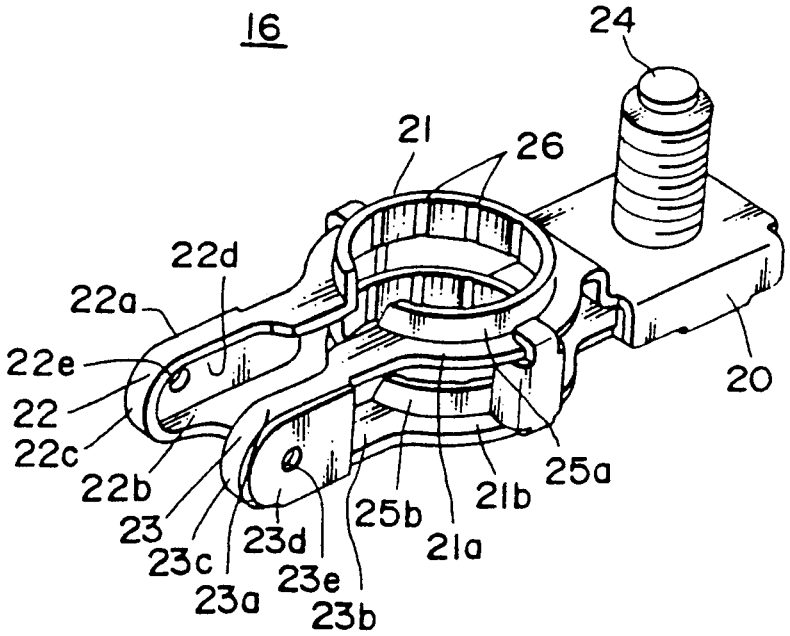
FIG. 2 is a perspective view showing the main body of the battery terminal of FIG. 1.

As shown in FIG. 2, the terminal main body 16 comprises a pair of upper and lower sections continuous with each other and having a similar configuration; and a curved portion intermediate between the upper and lower sections disposed at one end of the terminal main body 16.

The terminal main body 16 comprises an approximately rectangular electric wire connecting portion 20, to be connected with electric wires (not shown), disposed in the other end of the terminal main body 16. The terminal main body 16 further comprises two circular electrode engaging portions 21 continuous with the electric wire connecting portion 20. A free end is formed at one end, of each electrode engaging portion 21, disposed opposite to the electric wire connecting portion 20. Each free end is continuous with each of a pair of tightening plates 22 and 23.

A stud bolt 24 stands vertically on approximately the center of the electric wire connecting portion 20. The stud bolt 24 is connected with a terminal (not shown) connected with electric wires.

The electrode engaging portion 21 comprises pressing portions **25*a* and 25*b* formed vertically along the inner periphery of each of circular base portions 21*a* and 21*b* formed horizontally and grooves 26 formed vertically at regular intervals along the inner peripheral surface of the pressing portions 25*a* and 25*b***.

The tightening plates 22 and 23 comprise each of upper and lower tightening flat base plates **22*a*, 22*b* and 23*a*, 23*b* projecting from each free end of the electrode engaging portion 21; each of curved portions 22*c* and 23*c*, continuous with each of the base plates 22*a*, 22*b* and 23*a*, 23*b*; and each of bearing plates 22*d* and 23*d* installed on the outer surface of the base plates 22*a* and 22*b* and the outer surface of the base plates 23*a* and 23*b*, respectively so that each of the bearing plates 22*d* and 23*d* covers the space between the base plates 22*a* and 22*b* and the space between the base plates 23*a* and 23*b***.

Through-holes **22*e* and 23*e*, opposed to each other, for rotatably supporting the rotatable nut 18 are formed on each of the bearing plates 22*d* and 23*d*. The through-holes 22*e* and 23*e* are disposed at a position corresponding to approximately the center of each of the curved portions 22*c* and 23*c***, respectively.

Figure 3A:
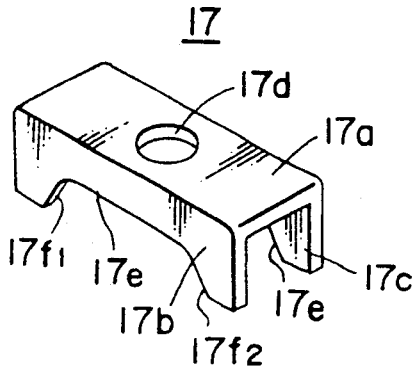
FIG. 3A is a perspective view showing a tightening tool.

The tightening tool 17 is installed on the tightening plates 22 and 23. As shown in FIG. 3A, the tightening tool 17 is sectionally U-shaped. That is, the tightening tool 17 comprises an upper wall **17*a* and side walls 17*b* and 17*c*. An installing through-opening 17*d* through which the bolt 19 is inserted is formed at approximately the center of the upper wall 17*a* of the tightening tool 17. An approximately trapezoidal portion is cut out from each of the side walls 17b and 17c to form cut-out portions 17e and 17e, opposed to each other, on each of the side walls 17b and 17c. A tapered surface of the side wall 17b and that of the side wall 17c** is denoted as $17f_1$ and $17f_2$, respectively.

The tightening tool 17 is installed on the tightening plates 22 and 23 by inserting the tightening plates 22 and 23 into the cut-out portions 17e and 17e of each of the side walls 17b and 17c thereof. As a result, the tapered surfaces $17f_1$ and $17f_2$ opposed to each other are brought into contact with the outer upper surface of each of the tightening plates 22 and 23. Therefore, due to the tightening of the bolt 19, the tightening tool 17 moves downward. As a result, the tightening plates 22 and 23 approach to each other along the $17f_1$ and $17f_2$ as shown in FIG. 6.

Figure 3B:
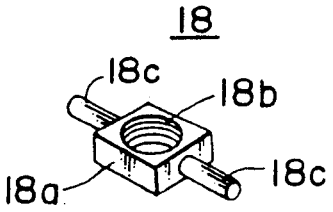
FIG. 3B is a perspective view showing a rotatable nut.

As shown in FIG. 3B, a bolt opening 18b is formed vertically through the center of a rectangular base 18a of the rotatable nut 18, and a pair of circular shafts 18c and 18c extend horizontally from the center of both opposed side walls of the base 18a.

Figure 4:
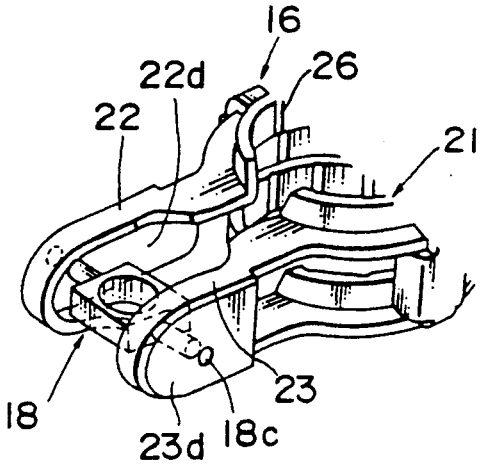
FIG. 4 is a perspective view showing the process of assembling a battery terminal.

As shown in FIG. 4, the length of the base 18a in the shaft-extending direction is shorter than the length between the tightening plates 22 and 23 so that the base 18a can be interposed therebetween, and the shafts 18c and 18c are inserted into the through-holes 22e and 23e, respectively in installing the rotatable nut 18 on the terminal main body 16.

The shafts 18c and 18c are rotatably supported by holes 22e and 23e, respectively and thus the base 18a is rotatable in the space between the tightening plates 22 and 23. Accordingly, the direction of the rotatable nut 18, namely, the direction of the bolt opening 18b can be adjusted to a desired direction.

The process of assembling the battery terminal 15 constructed as above is described below.

First of all, the rotatable nut 18 is installed on the terminal main body 16 as shown in FIG. 4. Then, as shown in FIG. 6, the tightening tool 17 is placed on the tightening plates 22 and 23 of the terminal main body 16.

Then, the bolt 19 is screwed a short distance into the bolt opening 18b of the rotatable nut 18 via the through-opening 17d of the tightening tool 17, with the axis of the through-opening 17d of the tightening tool 17 coinciding with that of the bolt opening 18b of the rotatable nut 18. In this manner, the battery terminal 15 is temporarily assembled as shown in FIG. 5.

Figure 5:
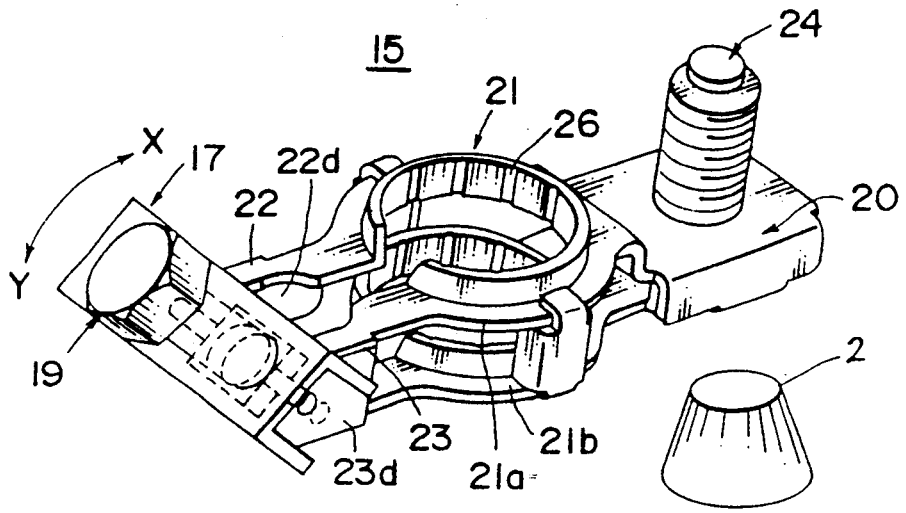
FIG. 5 is a perspective view showing the battery terminal temporarily assembled.

In installing the battery terminal 15 thus assembled on a battery mounted on a car, the battery post 2 is inserted into the electrode engaging portion 21, the free end of which is open as shown in FIG. 5. The rotatable nut 18 mounted on the terminal main body 16 by means of the tightening tool 17 and the bolt 19 is rotatable in X-direction or Y-direction in FIG. 5. That is, the rotatable nut 18 can be fixed at a desired position at which the bolt 19 can be tightened most easily.

Figure 6A:
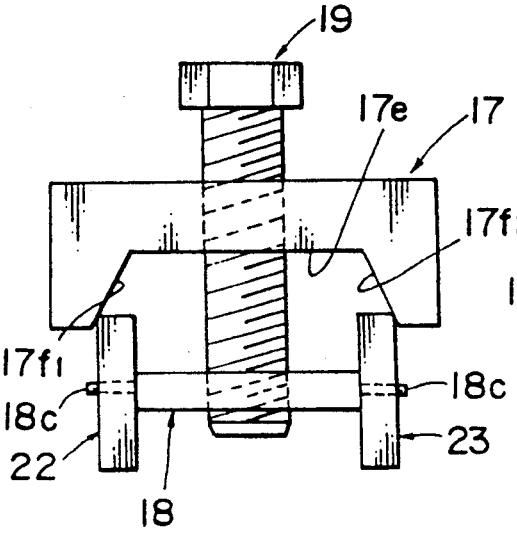
FIGS. 6A and 6B are views each showing a tightening process performed by means of a part of the battery terminal.
Figure 6B:
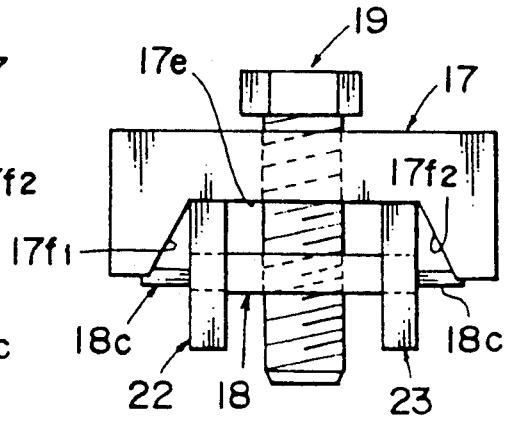
Figure 7:
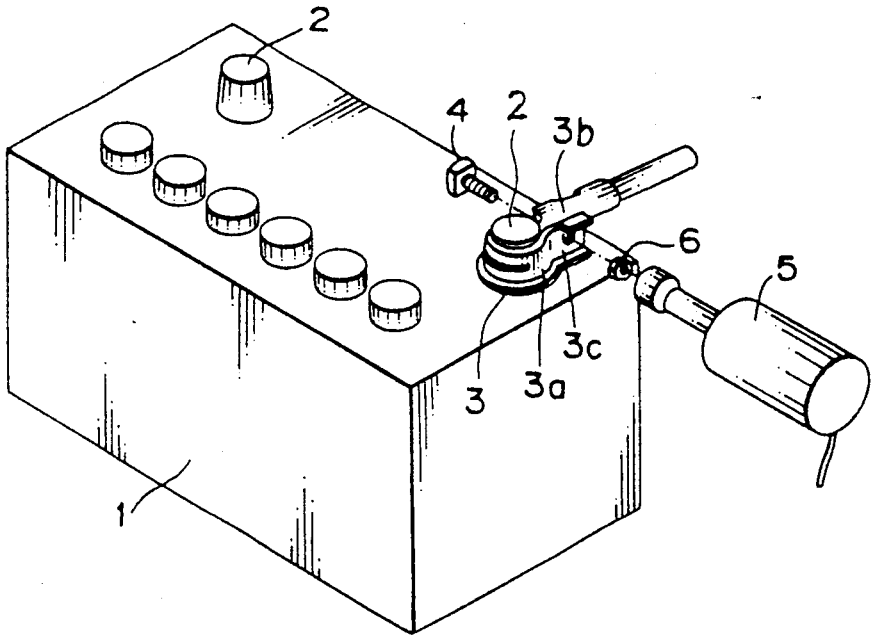
Fig. 7 PRIOR ART
FIG. 7 is a perspective view showing a state in which a conventional battery terminal is installed on a battery post.
Figure 8:
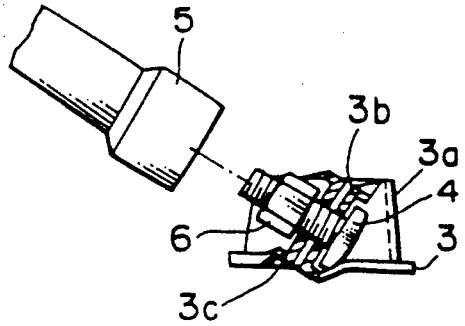
Fig. 8 PRIOR ART
FIG. 8 is a front view showing a state in which a different conventional battery terminal is installed on a battery post.
Figure 9A:
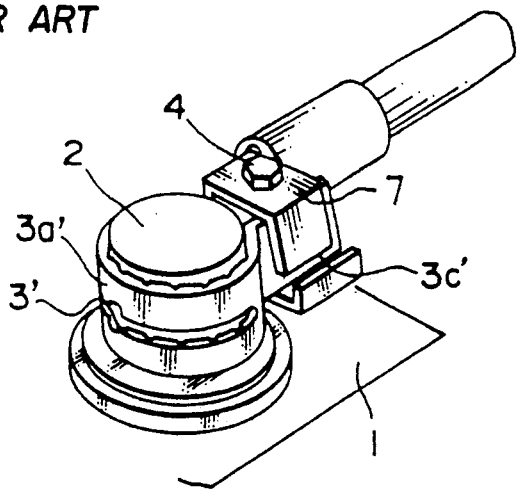
Fig. 9A PRIOR ART
FIG. 9A is a perspective view showing a different conventional battery terminal.
Figure 9B:
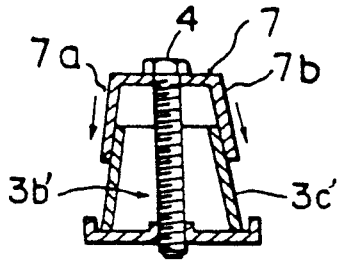
Fig. 9B PRIOR ART
FIG. 9B is a sectional view showing an operation of installing the conventional battery terminal of FIG. 9A on the battery post.

FIG. 6A and 6B show the state in which the bolt 19 is tightened vertically downward into the bolt opening 18b. In the state in which the battery terminal 15 has been temporarily assembled, namely, in the state in which the bolt 19 has been screwed a short distance into the bolt opening 18b as shown in FIG. 6A, the lower end of the tapered surfaces $17f_1$ and $17f_2$ formed on the cut-out portions 17e and 17e of the tightening tool 17 are in contact with the outer upper surface of the tightening plates 22 and 23.

Then, the bolt 19 is tightened into the bolt opening 18b by an impact wrench (not shown). With the downward movement of the tightening tool 17, the tightening plates 22 and 23 sandwiched between the tapered surfaces $17f_1$ and $17f_2$ approach to each other along the tapered surfaces $17f_1$ and $17f_2$. This is because the interval between the tapered surfaces $17f_1$ and $17f_2$ at an upper portion thereof is shorter than the interval between the tapered surfaces $17f_1$ and $17f_2$ at a lower portion thereof.

Consequently, the open free end of the electrode engaging portion 21 continuous with the tightening plates 22 and 23 is moved in the closing direction thereof, thus tightening the battery post 2. In this manner, the terminal main body 16 is fixed to the battery post 2.

In moving the electrode engaging portion 21 in the closing direction thereof, the grooves 26 formed on the pressing portions 25a and 25b allow the pressing portions 25a and 25b to be easily flexed and brought into close contact with the battery post 2. In this manner, the pressing portions 25a and 25b can be mounted on the battery post 2 tightly.

The construction of the battery terminal 15 is not limited to the above-described one, but other constructions may be adopted. For example, the electric wire connecting portion 20 of the terminal main body 16 may be constructed in the configuration of a barrel so that electric wires are connected to the electric wire connecting portion 20 by applying pressure to the electric wire.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A battery terminal for fixing a circular electrode engaging portion thereof to an outer surface of a battery post, comprising: a terminal main body including a pair of tightening plates, each having a through-hole formed thereon, continuous with an open free end of the electrode engaging portion into which the battery post is inserted, and an electric wire connecting portion continuous with the electrode engaging portion, a rotatable nut interposed between the tightening plates in such a manner that a supporting shaft projecting from each of opposed side walls of the rotatable nut is rotatably inserted through each of the opposed through-holes formed on the tightening plates; and a tightening tool, having an trapezoidal cut-out portion which is formed on each of side walls thereof and has a pair of tapered surfaces which are brought into contact with an outer surface of each of the tightening plates; and a bolt-installing through-hole, formed on an upper surface of said tightening tool, through which a bolt is tightened into the rotatable nut.

2. The battery terminal as defined in claim 1, wherein the bolt is tightened, via the bolt-installing through-hole of the tightening tool, into the rotatable nut located at a angle by means of the shafts of the rotatable nut, and the tapered surfaces of the tightening tool move the tightening plates in a direction in which the free end of the electrode engaging portion is closed.

3. The battery terminal as defined in claim 1, wherein the more the bolt is tightened into the bolt opening of the nut via the tightening tool, the more the tapered surfaces of the tightening tool move the tightening plates in a direction in which the free end of the electrode engaging portion is closed.

4. A battery terminal for fixing a circular electrode engaging portion thereof to an outer surface of a battery post, comprising:

a main body comprising a pair of tightening plates, each having a through-hole formed thereon, continuous with an open free end of the electrode engaging portion into which the battery post is inserted; and an electric wire connecting portion continuous with the electrode engaging portion;

a rotatable nut interposed between the tightening plates in such a manner that a supporting shaft projecting from each of opposed side walls of the rotatable nut is rotatably inserted through each of the opposed through-holes formed on the tightening plates;

a tightening tool, approximately U-shaped, having an approximately trapezoidal cut-out portion which is formed on each of side walls thereof and has a pair of tapered surfaces which are to be brought into contact with an outer surface of each of the tightening plates; and a bolt-installing through-hole, formed on an upper surface thereof, through which a bolt is tightened into the rotatable nut, wherein:

the bolt is tightened, via the bolt-installing through-hole of the tightening tool, into the rotatable nut located at a desired angle by means of the shafts of the rotatable nut; and the tapered surfaces of the tightening tool move the tightening plates in a direction in which the free end of the electrode engaging portion is closed.

* * * * *

UNITED STATES PATENT AND TRADEMARK OFFICE

CERTIFICATE OF CORRECTION

PATENT NO. : 5,302,142
DATED : April 12, 1994
INVENTOR(S) : Masaaki TABATA

It is certified that error appears in the above-indentified patent and that said Letters Patent is hereby corrected as shown below:

At column 5, line 29 of the printed patent, change "supported by" to ---supported by the through- ---.

At column 6, line 43 (claim 1, line 3) of the printed patent, change "a terminal main body" to ---a main body---.

Signed and Sealed this

Twenty-third Day of May, 1995

*Attest:*

Bruce Lehman

BRUCE LEHMAN

*Attesting Officer*

*Commissioner of Patents and Trademarks*